US012007186B2

(12) United States Patent
Eckelkamp et al.

(10) Patent No.: US 12,007,186 B2
(45) Date of Patent: Jun. 11, 2024

(54) TRIGGER LOCK

(71) Applicant: AOB Products Company, Columbia, MO (US)

(72) Inventors: Brett Eckelkamp, Fulton, MO (US); Michael Cottrell, Ashland, MO (US); Sherry Xu, Ningbo Zhejiang (CN); Brian Steere, Columbia, MO (US)

(73) Assignee: AOB Products Company, Columbia, MO (US)

( * ) Notice: Subject to any disclaimer, the term of this patent is extended or adjusted under 35 U.S.C. 154(b) by 0 days.

(21) Appl. No.: 17/231,801

(22) Filed: Apr. 15, 2021

(65) Prior Publication Data

US 2021/0325135 A1 Oct. 21, 2021

Related U.S. Application Data

(60) Provisional application No. 63/010,168, filed on Apr. 15, 2020.

(51) Int. Cl.

| | |
|---|---|
| ***F41A 17/54*** | (2006.01) |
| *F41A 17/02* | (2006.01) |
| *F41A 17/04* | (2006.01) |

(52) U.S. Cl.

CPC ..... *F41A 17/54* (2013.01); *F41A 17/02* (2013.01); *F41A 17/04* (2013.01)

(58) Field of Classification Search

CPC ..... F41A 17/54; F41A 17/46; F41A 17/02; F41A 17/04

See application file for complete search history.

(56) References Cited

U.S. PATENT DOCUMENTS

| | | | | |
|---|---|---|---|---|
| 3,392,471 | A * | 7/1968 | Foote | F41A 17/02 42/70.07 |
| 3,422,560 | A | 1/1969 | Foote et al. | |
| 3,624,945 | A * | 12/1971 | Foote | F41A 17/02 42/70.07 |
| 4,328,687 | A | 5/1982 | Ritchie | |
| 4,499,681 | A | 2/1985 | Bako et al. | |
| 4,723,370 | A | 2/1988 | Sheehan | |
| 5,392,552 | A | 2/1995 | McCarthy et al. | |
| 5,400,538 | A | 3/1995 | Shannon | |
| 5,535,605 | A | 7/1996 | Werner | |

(Continued)

FOREIGN PATENT DOCUMENTS

| | | | | |
|---|---|---|---|---|
| CA | 2330507 A1 * | 7/2001 | ..... | F41A 17/54 |
| CN | 201488634 U * | 5/2010 | ..... | F41A 17/54 |

(Continued)

*Primary Examiner* — Jonathan C Weber
(74) *Attorney, Agent, or Firm* — Stinson LLP

(57) ABSTRACT

A trigger lock for a trigger of a firearm, components thereof, and associated methods. The trigger lock comprises a first guard including a bolt having a catch. The trigger lock includes a second guard comprising a bolt receiver configured to receive the bolt to connect the first and second guards with the trigger between the first and second guards for obstructing access to the trigger. The bolt receiver includes a keeper arranged to engage the catch when the bolt is in the bolt receiver to maintain the first and second guards connected to each other. The second guard includes a shield overlying the bolt receiver and configured to obstruct cutting of the bolt receiver to disengage the keeper from the at least one catch.

25 Claims, 9 Drawing Sheets

(56) References Cited

U.S. PATENT DOCUMENTS 5,638,627 A 6/1997 Klein et al.
5,647,158 A * 7/1997 Eskelinen ..... F41A 17/54 42/70.07
5,704,152 A 1/1998 Harrison et al.
D393,305 S 4/1998 Misner et al.
5,832,647 A * 11/1998 Ling ..... F41A 17/54 42/70.07
5,899,102 A 5/1999 Ling
5,918,402 A 7/1999 Weinraub
6,055,759 A 5/2000 Langner
6,205,695 B1 3/2001 Schnell
6,269,575 B1 8/2001 Chang
6,308,540 B1 * 10/2001 Lee ..... E05B 73/0005 42/70.07
6,389,727 B2 5/2002 Schnell
6,405,469 B1 6/2002 Walsh
6,408,555 B1 6/2002 Sapia et al.
D462,735 S 9/2002 Rohde et al.
6,460,283 B1 10/2002 Ramos
6,474,238 B1 11/2002 Weinraub
6,487,803 B1 12/2002 Yu
6,510,640 B2 1/2003 Strong
6,601,332 B1 8/2003 Riebling
D485,595 S 1/2004 Schaub
6,718,678 B2 4/2004 Riebling et al.
6,722,071 B1 4/2004 Lin
6,755,059 B1 6/2004 Nall
D537,143 S 2/2007 Farchione et al.
7,216,449 B2 5/2007 Riebling et al.
7,281,397 B2 10/2007 Victor
7,367,150 B2 5/2008 Farchione et al.
7,584,566 B2 9/2009 Victor et al.
8,186,088 B2 5/2012 Victor et al.
8,402,799 B2 3/2013 Victor
8,819,979 B2 9/2014 Kelly
8,991,087 B2 * 3/2015 Ruffin ..... F41A 17/066 42/70.07
9,175,503 B2 11/2015 Herdman
9,448,025 B2 9/2016 Farr et al.
10,048,032 B1 8/2018 Lazar et al.
10,563,953 B2 2/2020 Tedder et al.
2001/0011432 A1 * 8/2001 Schnell ..... F41A 17/54 42/70.07
2002/0069569 A1 * 6/2002 Riebling ..... F41A 17/54 42/70.07
2004/0216349 A1 * 11/2004 Riebling ..... F41A 17/54 42/70.07
2005/0044910 A1 3/2005 Sloan
2006/0117633 A1 6/2006 Chang
2008/0034635 A1 * 2/2008 Victor ..... F41A 17/02 42/70.07
2010/0154271 A1 * 6/2010 Victor ..... F41A 17/063 42/70.07
2013/0312306 A1 * 11/2013 Ruffin ..... F41A 17/44 42/70.07
2015/0033609 A1 2/2015 Herdman
2015/0198402 A1 * 7/2015 Brace ..... F41A 17/54 42/70.06
2016/0061547 A1 * 3/2016 Farr ..... F41A 17/54 42/70.06
2016/0377362 A1 * 12/2016 Farr ..... F41A 17/54 42/70.06
2017/0023325 A1 * 1/2017 Farr ..... F41A 17/54
2017/0191775 A1 7/2017 Bibee et al.
2019/0212086 A1 7/2019 Shiner et al.

FOREIGN PATENT DOCUMENTS

CN 201653259 U * 11/2010 ..... F41A 17/54
DE 0740122 A2 * 3/1996 ..... F41A 17/54
DE 0740122 B1 * 3/1996 ..... F41A 17/54
DE 19511155 A1 * 10/1996 ..... F41A 17/04
GB 1157247 A * 4/1968 ..... F41A 17/54

* cited by examiner

TRIGGER LOCK

CROSS-REFERENCE TO RELATED APPLICATION

The present application claims priority to U.S. Provisional Patent Application No. 63/010,168, filed on Apr. 15, 2020, which is hereby incorporated by reference in its entirety.

FIELD

The present disclosure generally relates to trigger locks for firearms.

BACKGROUND

Trigger locks are used to secure or obstruct access to triggers of weapons to prevent firing of the weapons. Various trigger lock designs exist, with varying effectiveness and convenience.

SUMMARY

In one aspect, a trigger lock for a trigger of a firearm is disclosed. The trigger lock comprises a first guard including a bolt having a catch and a second guard comprising a bolt receiver configured to receive the bolt to connect the first and second guards with the trigger between the first and second guards for obstructing access to the trigger. The bolt receiver further includes a keeper arranged to engage the catch of the bolt when the bolt is in the bolt receiver. This maintains the first and second guards in connection with each other. The second guard also includes a shield which overlies the bolt receiver. The shield is configured to obstruct cutting of the bolt receiver to resist tampering with the trigger lock.

Other objects and features of the present disclosure will be in part apparent and in part pointed out herein.

BRIEF DESCRIPTION OF THE DRAWINGS

Corresponding reference numbers indicate corresponding parts throughout the drawings.

DETAILED DESCRIPTION

Figure 1:
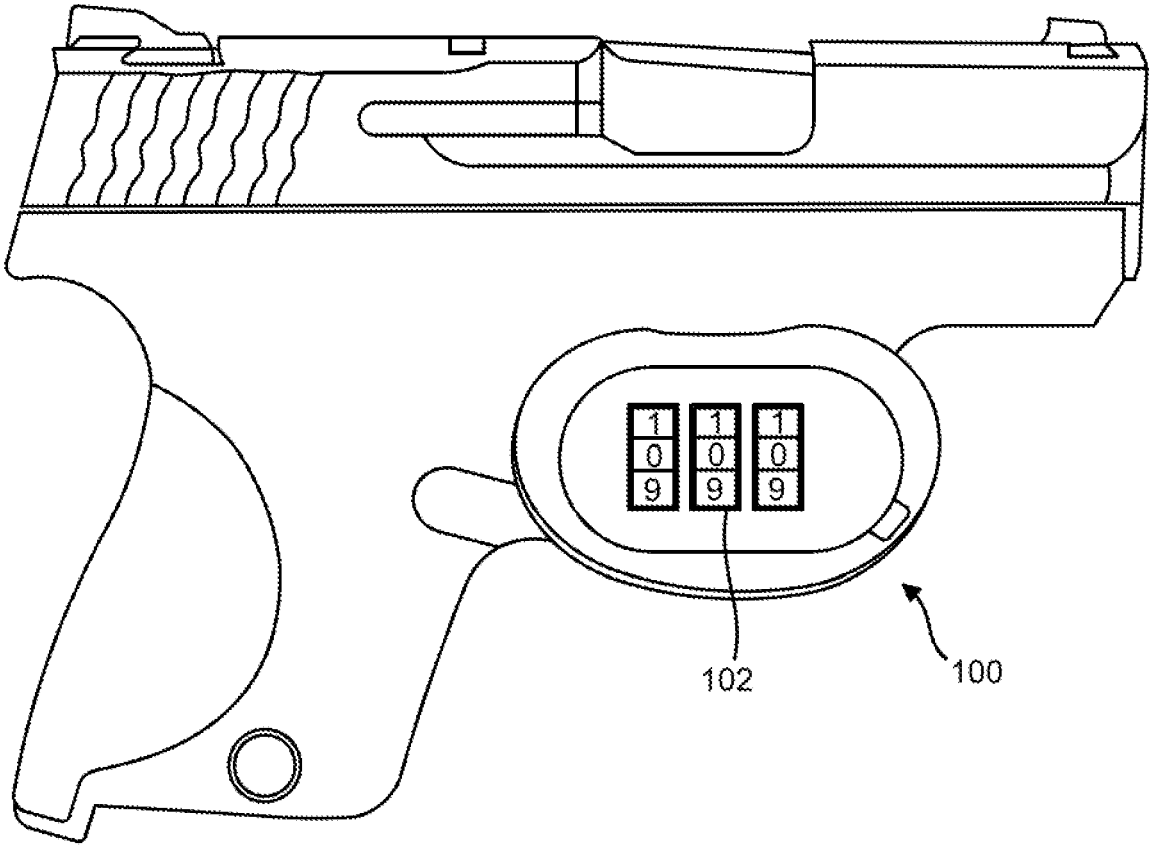
FIG. 1 is a side view of a firearm with a trigger lock of the present disclosure.

Referring to FIG. 1, a trigger lock 100 is shown in use on a firearm. The trigger lock 100, when in use, obstructs access to a trigger of the firearm (e.g., to facilitate safe storage of the firearm). The firearm typically includes a trigger guard extending around the firearm trigger. The trigger lock 100 can sandwich the trigger guard and/or the trigger to prevent actuation of the trigger.

In the embodiment shown in FIG. 1, the trigger lock 100 includes a combination lock 102 including a plurality of numbered wheels 102A permitting a user to enter a numeric code for locking and unlocking the trigger lock. Other types of locks (e.g., key lock) can be used without departing from the scope of the present disclosure.

Figure 2:
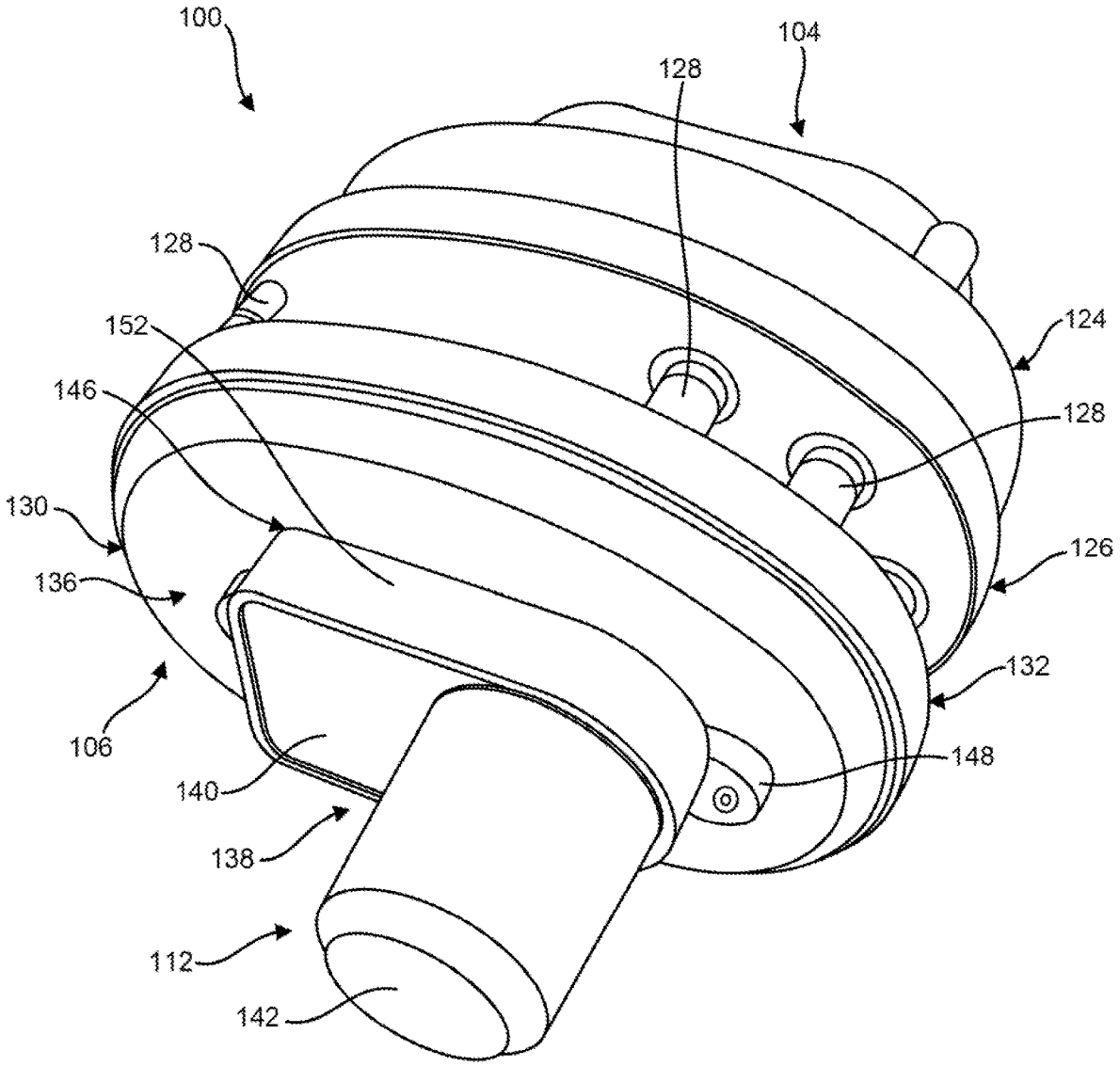
FIG. 2 is a rear perspective of the trigger lock.

Referring to FIG. 2, the trigger lock 100 comprises a first guard 104 and a second guard 106. The guards 104, 106 are connectable to each other to sandwich the trigger guard for installation on the firearm. The guards 104, 106 are selectively separable from each other to remove the trigger lock 100 from the firearm. For example, entering a preset numeric code into the combination lock 102 permits the user to pull the guards 104, 106 apart from each other and thus remove the trigger lock from the firearm.

The first guard 104 includes a bolt 108 having a plurality of bolt teeth 110 (broadly, catches). The second guard 106 includes a bolt receiver 112 having a recess arranged to receive the bolt 108 to connect the first and second guards 104, 106 to each other. The bolt receiver 112 includes a keeper 114 arranged to engage the teeth of the bolt 108 to retain the bolt in the recess. The keeper 114 includes a retainer 116 and a spring 118. The retainer includes a plurality of retainer teeth 120 arranged to engage the bolt teeth 110 to prevent withdrawal of the bolt 108 from the recess. The spring 118 biases the retainer 116 toward a retaining position for engagement of the retainer teeth 120 with the bolt teeth 110. As the guards 104, 106 are moved closer together, the bolt 108 moves farther into the recess, and the retainer 116 rides on the bolt teeth 110, temporarily deflecting against the spring 118 bias to permit bolt teeth to move past the retainer. The arrangement is such that the retainer 116 ratchets on the bolt teeth 110, and when the guards 104, 106 are moved sufficiently together to sandwich the trigger guard, the retainer engages the bolt teeth in locking engagement to prevent withdrawal of the bolt 108 from the bolt receiver 112 and thus preventing removal of the trigger lock 100 from the firearm.

To remove the trigger lock 100 from the firearm, the user enters the correct numeric code into the combination lock 102, which permits the user to rotate the bolt 108 about a longitudinal axis of the bolt via a bolt actuator 122. Rotating the bolt 108 rotates the bolt teeth 110 out of registration with respect to the retainer teeth 120 and brings a smooth surface of the bolt into engagement with the retainer 116. The guards 104, 106 can then be separated by sliding the bolt 108 out of the bolt receiver 112 as the retainer 116 rides on the smooth surface of the bolt.

The first guard 104 includes a housing 124 and a cover 126. The first guard housing 124 houses the wheels of the combination lock 102. The first guard cover 126 covers a rear side of the first guard housing 124 and is arranged to face the firearm when the trigger lock 100 is installed. The first guard cover 126 partially defines a jaw for engaging the firearm. The jaw includes a first plurality of protrusions 128 extending rearward to facilitate forming a connection with the firearm and/or for obstructing access to the trigger. The bolt 108 extends rearward from the jaw for engagement with the second guard 106.

The second guard 106 includes a housing 130 and a cover 132. The second guard housing 130 houses the keeper 114 and partially defines the recess for receiving the bolt 108. The second guard cover 132 covers a front side of the second guard housing 130 and is arranged to face the firearm when the trigger lock is installed. The cover partially defines a jaw for engaging the firearm. The jaw includes a second plurality of protrusions 134 extending forward to facilitate forming a connection with the firearm and/or for obstructing access to the trigger. The recess for receiving the bolt 108 extends rearward from the jaw into the second guard housing 130.

The second guard housing 130 can be made of any suitable material, such as steel, aluminum, or other metal. In one embodiment, the guard housings 124, 130 are made of cast aluminum. The second guard housing 130 includes a main body 136 having a rearward facing outer surface that defines a portion of the outer surface of the second guard 106. Projecting rearward from the main body 136 is a protrusion 138. The protrusion includes a first segment 140 and a second segment 142 extending rearward from the first segment. The first segment 140 (broadly, keeper housing) is wider than the second segment 142 and houses the spring 118 and part of the retainer 116. The second segment 142 is generally cylindrical and has a bore partially defining the bolt-receiving recess 144. The bolt 108 is receivable in the recess 144 along a bolt-receiving axis A to engage the bolt teeth 110 with the keeper 114. The bolt receiver 112 comprises the protrusion 138 and the keeper 114. The protrusion 138 extends rearward from the main body 136 along the bolt-receiving axis A. The first segment 140 of the protrusion 138 extends laterally with respect to the bolt receiving axis A and with respect to the cylindrical second segment 142 of the protrusion 138. It will be appreciated that the protrusion 138 can have other configurations without departing from the scope of the present disclosure.

Figure 3:
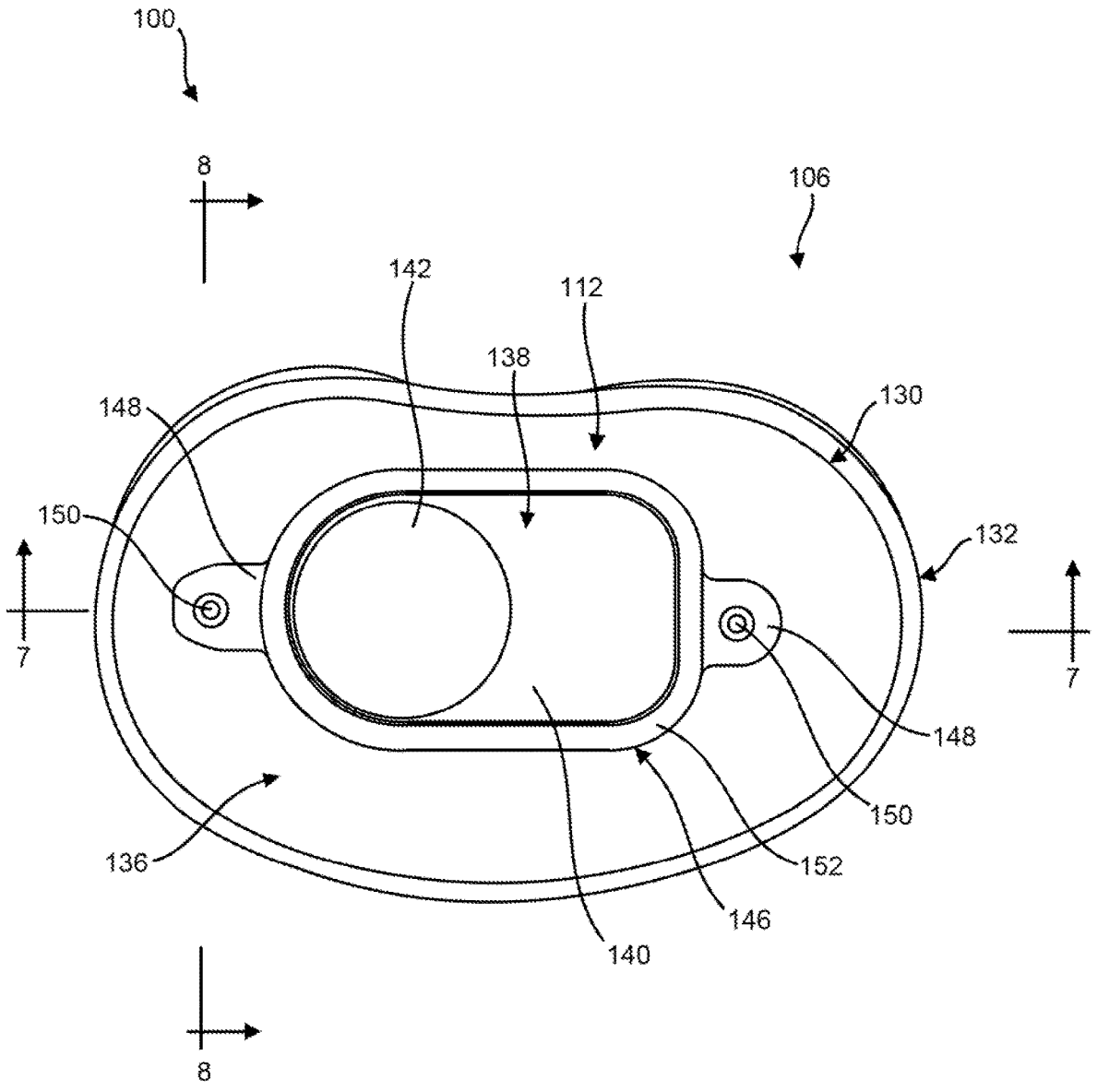
FIG. 3 is a rear elevation of the trigger lock.
Figure 4:
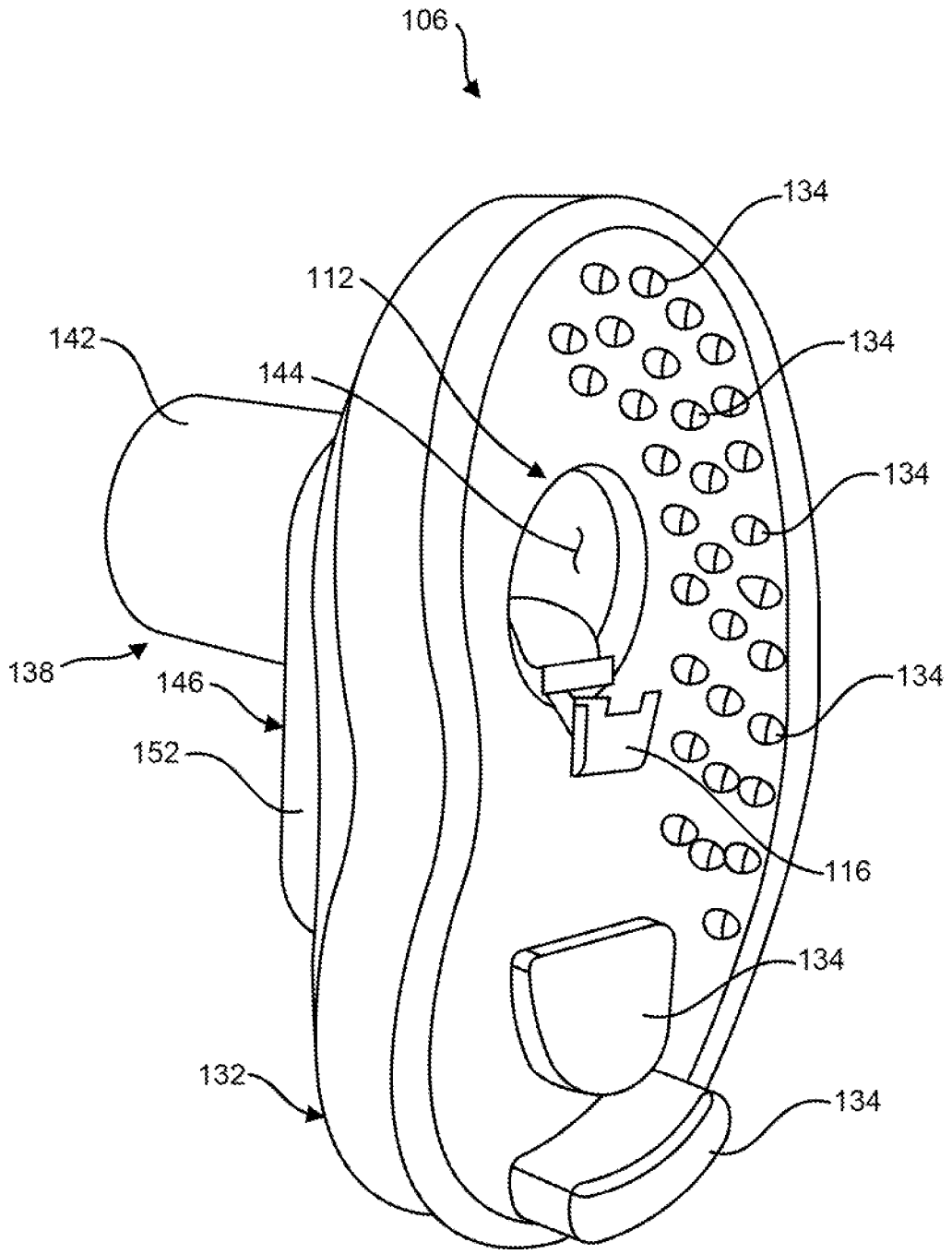
FIG. 4 is a perspective of a rear guard of the trigger lock.
Figure 5:
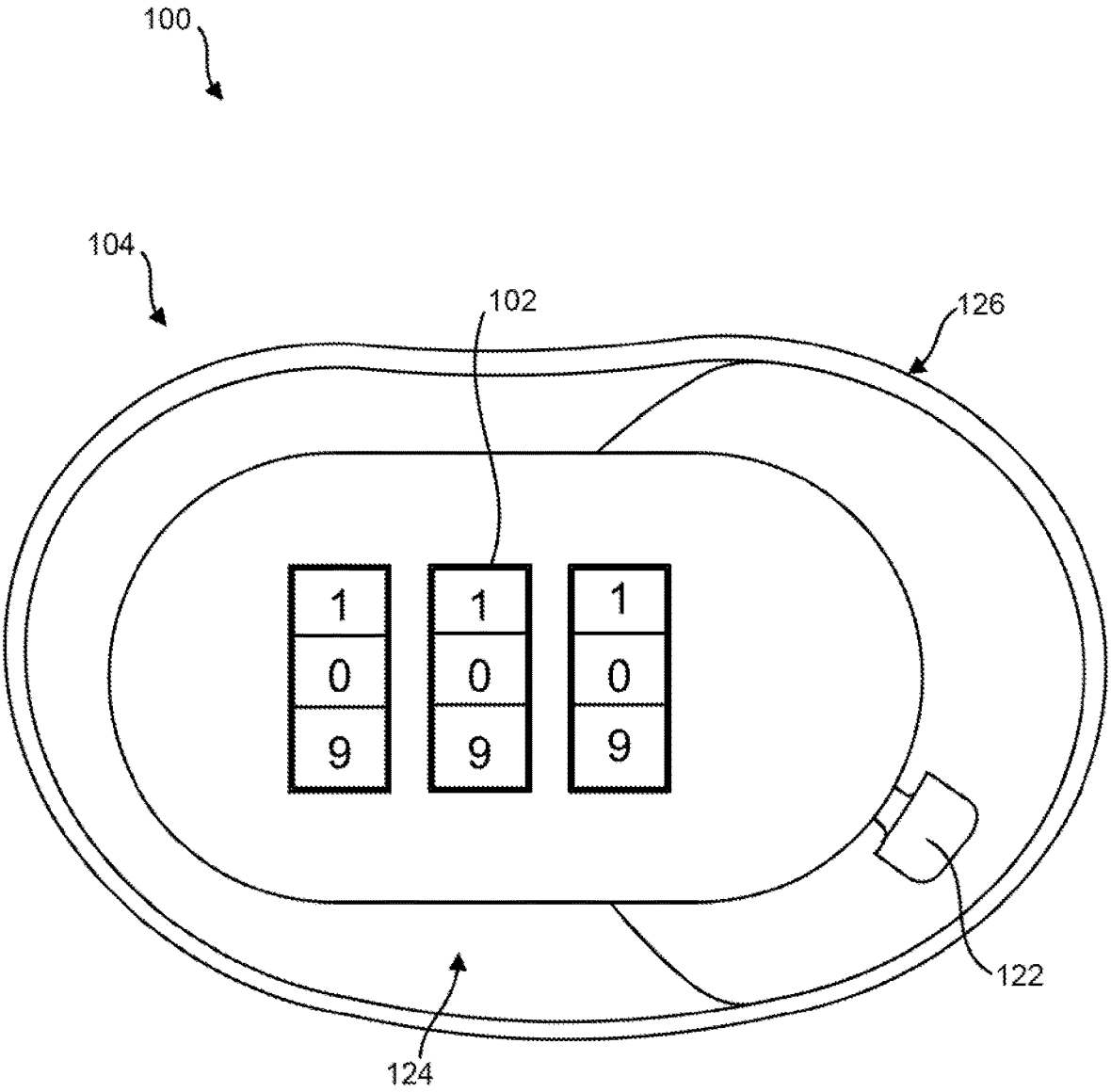
FIG. 5 is a front elevation of a front guard of the trigger lock.
Figure 6:
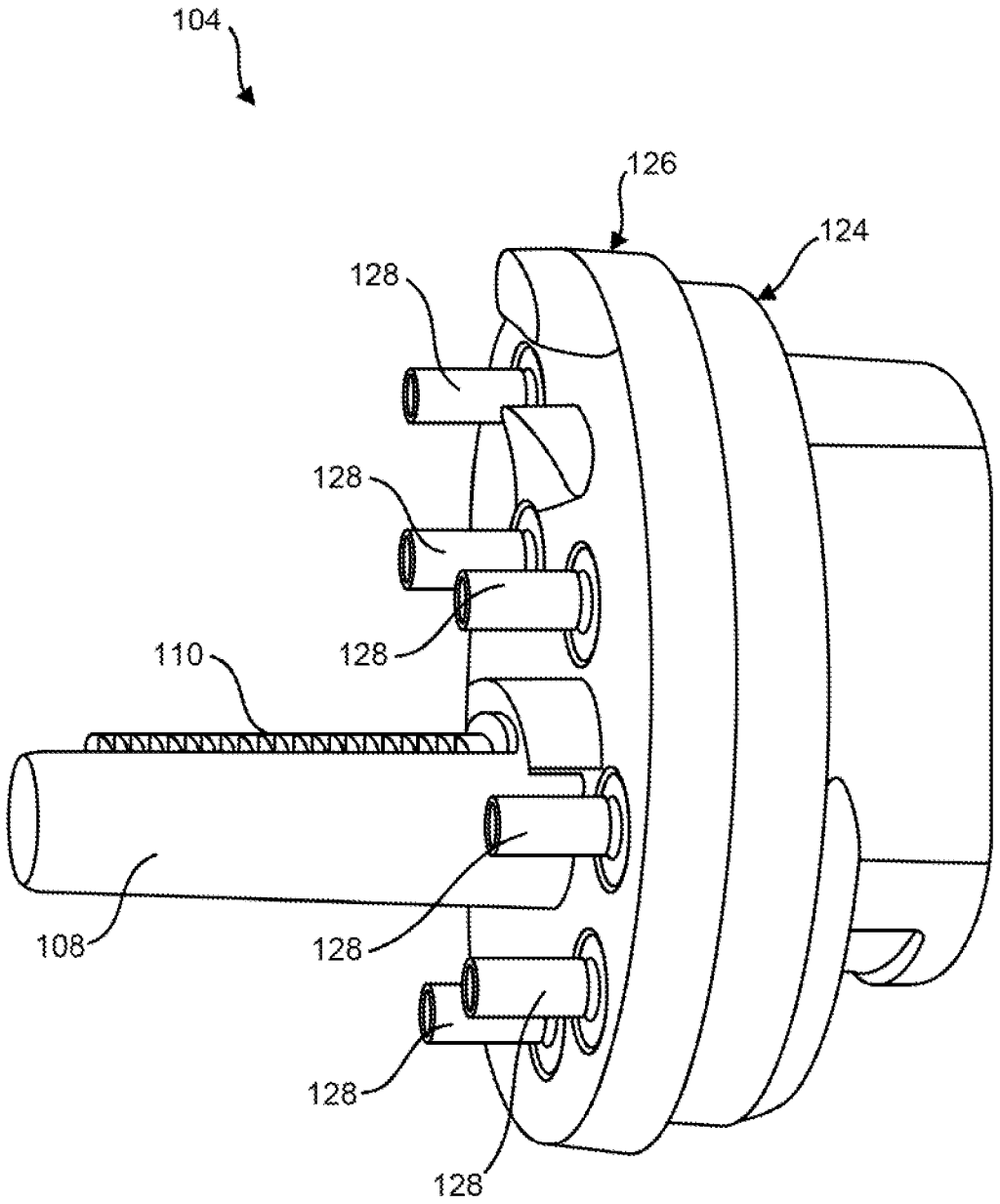
FIG. 6 is a perspective of the front guard.
Figure 7:
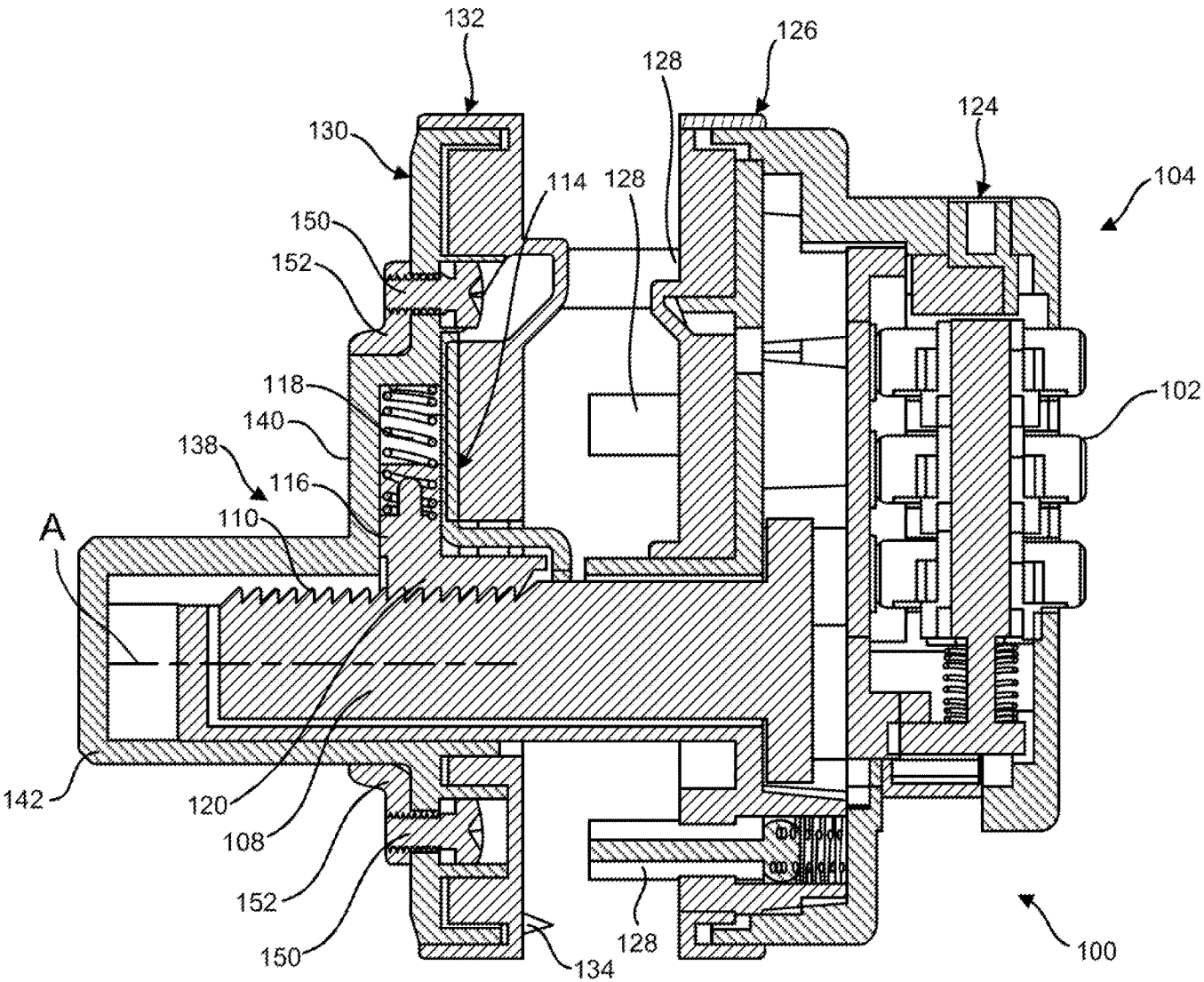
FIG. 7 is a section of the trigger guard taken in a plane extending along line 7-7 of FIG. 3.
Figure 8:
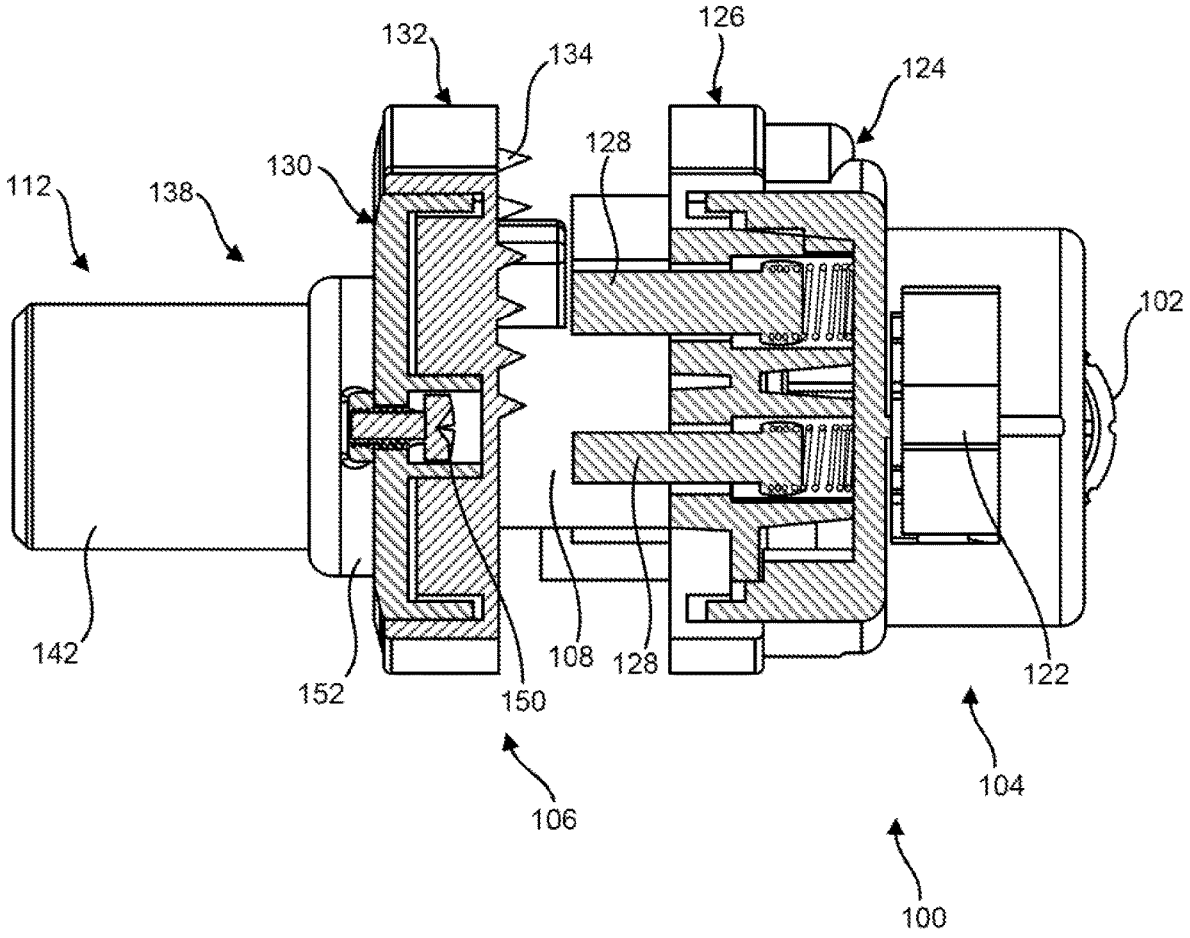
FIG. 8 is a section of the trigger guard taken in a plane extending along line 8-8 of FIG. 3.

Referring to FIGS. 2 and 3, the second guard 106 includes a shield 146 configured to resist tampering with the trigger lock 100. When the trigger lock 100 is installed on a firearm, the second guard 106 is a potentially vulnerable component of the trigger lock where a person may try to compromise the trigger lock to remove it from a firearm without properly unlocking the trigger lock. It will be appreciated that a person not knowing the combination lock code may desire to remove the lock and may attempt to do so by tampering with the lock (e.g., by damaging the lock). For example, a person may attempt to cut the bolt receiver 112 to displace or remove the keeper 114 and/or spring 116 to disengage the retainer teeth 120 from locking engagement with the bolt teeth 110. The shield 146 is configured to resist certain types of tampering. For example, the shield 146 overlies the bolt receiver 112, and in particular the keeper housing 140 and keeper 114, to obstruct tampering (e.g., cutting) with the bolt receiver or attempts to remove the keeper from locking engagement with the bolt teeth 110 (e.g., by cutting off the protrusion 138 and/or by removing the spring 118, or prying the keeper from outside the housing 108). The shield 146 may be formed of steel or another suitable material (e.g., more resistant to cutting than aluminum) that is an obstacle to cutting or sawing through the protrusion 138 or keeper housing 140. Regardless of differences in material of the second guard housing 130 and shield 146, the shield presents an obstacle that may deter or prevent someone from compromising the trigger lock 100 to improperly open the trigger lock.

In the illustrated embodiment, the shield 146 is configured to overlie the bolt receiver 112 such that the shield at least partially covers the protrusion 138. In particular, the shield 146 overlies a portion of the main body 136 and overlies sides of the keeper housing 140. The shield 146 includes a collar 152 defining a band extending around the keeper housing 140. In some embodiments, the collar 152 may not extend all the way around the protrusion 138. The collar 152 has an open end out of which the protrusion 138 extends. In the illustrated embodiment, the cylindrical second portion 142 of the protrusion 138 is entirely out of the open end of the collar. Other arrangements can be used without departing from the scope of the present disclosure. For example, the shield 146 can have a closed end and entirely house the protrusion.

The shield 146 has an inner surface facing and in engagement with the bolt receiver 112. The shield 146 is sized and shaped to closely conform to the main body 136 of the second guard housing 130 and the protrusion 138. The shield 146 is seated against the main body 136 and extends from a juncture of the main body and protrusion 138 away from the main body portion rearward along the protrusion. In the illustrated embodiment, portions of the main body 136 are exposed outboard of the shield 146. The shield includes two flanges 148 extending laterally from the collar 152 for connecting the shield to the second guard housing 130. The flanges 148 extend transversely with respect to the protrusion 138 (and the bolt-receiving axis A) and abut the main body portion 136.

In the illustrated embodiment, the flanges 148 include respective bosses that extend into openings in the main body 136. The bosses have threaded openings, and screws 150 (broadly, fasteners) are threaded into the openings from a front side of the housing to secure the shield 146 to the second guard housing 130. Heads of the screws 150 engage a front side of the second guard housing 130 to prevent the collar from being removed rearward off the protrusion. For example, in manufacture, the screws 150 can be installed to secure the shield 146 to the second guard housing 130, and then the second guard cover 132 can be installed, which covers the screw heads. In an alternative embodiment (not shown), the bosses can have a male thread, and nuts can be threaded onto the bosses to secure the shield 146 on the second guard housing 130. It will be appreciated that the bosses can be secured in place in other suitable ways.

Figure 9:
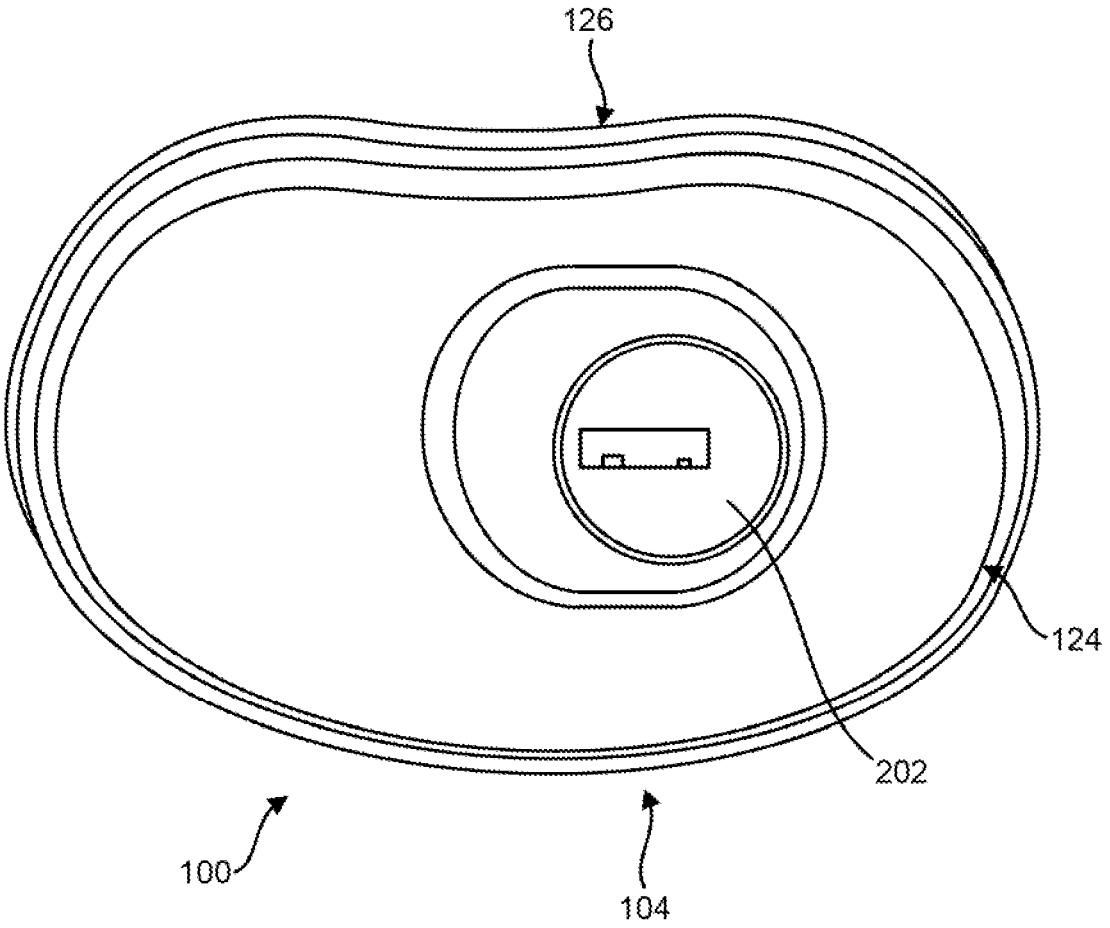
FIG. 9 is a side view of an alternate embodiment of a first guard.

Referring to FIG. 9, an alternative embodiment of the trigger lock 100 is shown. In this embodiment, the locking mechanism of the trigger lock 100 comprises a keyed lock 202 including a plurality of tumblers displaceable by a key. When the key is inserted into the locking mechanism, the bolt 108 can be rotated by rotating the key so that the first guard 104 and the second guard 106 can be disengaged from each other. Besides the difference in locks, the structure and function of the trigger lock is the same as described above.

It will be apparent that modifications and variations are possible without departing from the scope of the invention defined in the appended claims. As various changes could be made in the above constructions and methods without departing from the scope of the invention, it is intended that all matter contained in the above description and shown in the accompanying drawings shall be interpreted as illustrative and not in a limiting sense.

What is claimed is:

1. A trigger lock for a trigger of a firearm, the trigger lock comprising:

a first guard including a bolt having a catch; and a second guard comprising a housing including an outer face, the housing defining in part a bolt receiver configured to receive the bolt in a first direction to connect the first and second guards in a locked configuration in which the outer face of the housing faces away from the first guard with the trigger between the first and second guards for obstructing access to the trigger, the bolt receiver including a keeper arranged to engage the catch when the first and second guards are in the locked configuration, the second guard including a shield overlying the outer face of the housing and configured to obstruct cutting of the bolt receiver to resist tampering with the trigger lock;

wherein a connection of the shield to the housing is configured to secure the shield against removal from the housing in the first direction when the first and second guards are in an unlocked configuration and the bolt is removed from the bolt receiver, and wherein the connection comprises connection structure configured to prohibit non-destructive removal of the shield from the housing in the first direction by movement of the shield relative to the housing in the first direction when the bolt is removed from the bolt receiver.

2. A trigger lock as set forth in claim 1, wherein the second guard includes a main body, the bolt receiver comprising a protrusion protruding from the main body, the protrusion configured to at least partially receive the bolt therein when the bolt is received in the bolt receiver, the shield at least partially covering the protrusion.

3. A trigger lock as set forth in claim 2, wherein the housing includes the main body and the protrusion, the housing comprising a first material, the shield comprising a second material more resistant to cutting than the first material.

4. A trigger lock as set forth in claim 3, wherein the second material is steel.

5. A trigger lock as set forth in claim 2, wherein the shield is seated at a juncture of the protrusion and the main body.

6. A trigger lock as set forth in claim 5, wherein the shield includes a band extending around the protrusion.

7. A trigger lock as set forth in claim 6, wherein the shield includes a flange secured to the main body to maintain the shield in position on the protrusion.

8. A trigger lock as set forth in claim 7, wherein the flange is secured to the main body by a fastener.

9. A trigger lock as set forth in claim 8, wherein the shield includes at least one boss extending into an opening in the housing.

10. A trigger lock as set forth in claim 2, wherein the shield comprises a collar having an open end out of which the protrusion protrudes.

11. A trigger lock as set forth in claim 2, wherein at least a portion of the main body is exposed outboard of the shield.

12. A trigger lock as set forth in claim 2, wherein the shield comprises a flange extending laterally outboard of the collar.

13. A trigger lock as set forth in claim 12, wherein the flange abuts the main body.

14. A trigger lock as set forth in claim 2, wherein the shield is secured to the main body by a fastener.

15. A trigger lock as set forth in claim 2, wherein the shield includes a boss extending into an opening in the main body.

16. A trigger lock as set forth in claim 2, wherein the shield comprises an open end out of which the protrusion protrudes.

17. A trigger lock as set forth in claim 2, wherein the shield includes a collar overlying the protrusion and a flange extending laterally with respect to the protrusion and overlying the main body.

18. A trigger lock as set forth in claim 1, wherein the shield overlies the keeper.

19. A trigger lock as set forth in claim 1, wherein the connection structure comprises a fastener.

20. A trigger lock as set forth in claim 1, wherein the connection comprises a threaded connection.

21. A trigger lock for a trigger of a firearm, the trigger lock comprising:

a first guard including a bolt having a catch; and a second guard comprising a housing including an outer face, the housing defining in part a bolt receiver configured to receive the bolt to connect the first and second guards in a locked configuration in which the outer face of the housing faces away from the first guard with the trigger between the first and second guards for obstructing access to the trigger, the bolt receiver including a keeper arranged to engage the catch when the first and second guards are in the locked configuration, the second guard including a shield overlying the outer face of the housing and configured to obstruct cutting of the bolt receiver to resist tampering with the trigger lock;

wherein a connection of the shield to the housing to maintain the shield overlying the housing is configured to remain connected independent of the bolt being in the bolt receiver;

wherein the second guard includes a main body, the bolt receiver comprising a protrusion protruding from the main body, the protrusion configured to at least partially receive the bolt therein when the bolt is received in the bolt receiver, the shield at least partially covering the protrusion;

wherein the shield is seated at a juncture of the protrusion and the main body;

wherein the shield includes a band extending around the protrusion;

wherein the shield includes a flange secured to the main body to maintain the shield in position on the protrusion;

wherein the flange is secured to the main body by a fastener;

wherein the shield includes at least one boss extending into an opening in the housing;

wherein the boss comprises a threaded opening receiving the fastener.

22. A trigger lock for a trigger of a firearm, the trigger lock comprising:

a first guard including a bolt having a catch; and a second guard comprising a housing including an outer face, the housing defining in part a bolt receiver configured to receive the bolt to connect the first and second guards in a locked configuration in which the outer face of the housing faces away from the first guard with the trigger between the first and second guards for obstructing access to the trigger, the bolt receiver including a keeper arranged to engage the catch when the first and second guards are in the locked configuration, the second guard including a shield overlying the outer face of the housing and configured to obstruct cutting of the bolt receiver to resist tampering with the trigger lock;

wherein a connection of the shield to the housing to maintain the shield overlying the housing is configured to remain connected independent of the bolt being in the bolt receiver;

wherein the second guard includes a main body, the bolt receiver comprising a protrusion protruding from the main body, the protrusion configured to at least partially receive the bolt therein when the bolt is received in the bolt receiver, the shield at least partially covering the protrusion;

wherein the shield includes a boss extending into an opening in the main body;

wherein the boss includes a threaded opening in which a fastener is threaded to secure the shield to the main body.

23. A trigger lock for a trigger of a firearm, the trigger lock comprising:

a first guard including a bolt having a catch; and a second guard comprising a housing including an outer face, the housing defining in part a bolt receiver configured to receive the bolt to connect the first and second guards in a locked configuration in which the outer face of the housing faces away from the first guard with the trigger between the first and second guards for obstructing access to the trigger, the bolt receiver including a keeper arranged to engage the catch when the first and second guards are in the locked configuration, the second guard including a shield overlying the outer face of the housing and configured to obstruct cutting of the bolt receiver to resist tampering with the trigger lock;

wherein a connection of the shield to the housing to maintain the shield overlying the housing is configured to remain connected when the first and second guards are in an unlocked configuration and the bolt is removed from the bolt receiver;

wherein the second guard includes a main body, the bolt receiver comprising a protrusion protruding from the main body, the protrusion configured to at least partially receive the bolt therein when the bolt is received in the bolt receiver, the shield at least partially covering the protrusion;

wherein the shield includes a boss extending into an opening in the main body;

wherein the bolt is receivable in the protrusion in a receiving direction, the main body having a maximum width transverse to the receiving direction, the protrusion having a maximum width transverse to the receiving direction and being less than the maximum width of the main body.

24. A trigger lock for a trigger of a firearm, the trigger lock comprising:

a first guard including a bolt having a catch; and a second guard comprising a housing including an outer face, the housing defining in part a bolt receiver configured to receive the bolt to connect the first and second guards in a locked configuration in which the outer face of the housing faces away from the first guard with the trigger between the first and second guards for obstructing access to the trigger, the bolt receiver including a keeper arranged to engage the catch when the first and second guards are in the locked configuration, the second guard including a shield overlying the outer face of the housing and configured to obstruct cutting of the bolt receiver to resist tampering with the trigger lock;

wherein a connection of the shield to the housing to maintain the shield overlying the housing is configured to remain connected when the first and second guards are in an unlocked configuration and the bolt is removed from the bolt receiver;

wherein the connection of the shield securing the shield against removal from the housing comprises a threaded fastener.

25. A trigger lock for a trigger of a firearm, the trigger lock comprising:

a first guard including a bolt having a catch; and a second guard comprising a housing including an outer face, the housing defining in part a bolt receiver configured to receive the bolt to connect the first and second guards in a locked configuration in which the outer face of the housing faces away from the first guard with the trigger between the first and second guards for obstructing access to the trigger, the bolt receiver including a keeper arranged to engage the catch when the first and second guards are in the locked configuration, the second guard including a shield overlying the outer face of the housing and configured to obstruct cutting of the bolt receiver to resist tampering with the trigger lock;

wherein a connection of the shield to the housing to maintain the shield overlying the housing is configured to remain connected when the first and second guards are in an unlocked configuration and the bolt is removed from the bolt receiver;

wherein the connection of the shield securing the shield against removal from the housing is configured to require a tool to disconnect the connection.

* * * * *